United States Patent [19]

Satake et al.

[11] 4,455,149

[45] Jun. 19, 1984

[54] PROCESS FOR THE PRODUCTION OF FUEL COMPOSITIONS

[75] Inventors: Takeo Satake, Wakayama; Masahisa Ishigami, Hyogo; Kunio Arimoto, Hyogo; Yorishige Matsuba, Hyogo; Yoshikazu Inoue, Hyogo; Yusuke Tanaka, Tokyo; Kohei Kanda, Chiba, all of Japan

[73] Assignees: Maruzen Oil Co., Ltd.; Nippon Chemtec Consulting Inc., both of Osaka, Japan

[21] Appl. No.: 292,980

[22] Filed: Aug. 14, 1981

[30] Foreign Application Priority Data

Apr. 16, 1981 [JP] Japan ..... 56-58293

[51] Int. Cl.[3] ..... C10L 1/32

[52] U.S. Cl. ..... 44/51; 44/53; 44/56; 252/311.5; 252/312; 110/238; 110/218; 110/347; 406/47; 406/49

[58] Field of Search ..... 44/51, 55, 56, 61, 53; 110/238, 218, 347; 252/311.5, 312; 406/47, 49

[56] References Cited

U.S. PATENT DOCUMENTS

| | | | |
|---|---|---|---|
| 2,247,722 | 7/1941 | Chadder et al. | 252/311.5 |
| 2,332,542 | 10/1943 | Watts et al. | 252/311.5 |
| 2,372,924 | 4/1945 | Arnold | 252/311.5 |
| 4,046,519 | 9/1977 | Piotrowski | 44/51 |
| 4,083,698 | 4/1978 | Wenzel et al. | 44/51 |
| 4,088,454 | 5/1978 | Lee | 44/51 |
| 4,153,421 | 5/1979 | Marlin | 44/51 |
| 4,195,975 | 4/1980 | Hamuro et al. | 44/51 |
| 4,234,319 | 11/1980 | Beeson | 44/1 SR |

FOREIGN PATENT DOCUMENTS

| | | | |
|---|---|---|---|
| 55-160054 | 12/1980 | Japan . | |
| 691353 | 5/1953 | United Kingdom | 44/51 |

*Primary Examiner*—Charles F. Warren
*Assistant Examiner*—Margaret B. Medley
*Attorney, Agent, or Firm*—Sughrue, Mion, Zinn, Macpeak, and Seas

[57] ABSTRACT

A process for producing a dispersion composition suitable for use as a fuel is described, comprising kneading (a) a bituminous substance, (b) a low molecular weight aliphatic alcohol, and (c) water, a water-containing organic compound, or an aqueous organic compound suspension to provide a dispersion composition wherein the aqueous alcohol solution as a dispersed phase is dispersed in the bituminous substance as a continuous phase. By causing the phase inversion of the thus-obtained w/o type dispersion composition by kneading it along with a protective colloid at 5° C. to 60° C., and o/w type dispersion composition suitable for use as a fuel can be produced.

21 Claims, No Drawings

PROCESS FOR THE PRODUCTION OF FUEL COMPOSITIONS

FIELD OF THE INVENTION

The present invention relates to a process for the production of fuel compositions comprising bituminous substances, low molecular weight aliphatic alcohols, and water.

BACKGROUND OF THE INVENTION

Bituminous substances, such as asphalt, have poor fluidity, and can be burned only with difficulty. Furthermore, the bituminous substances have the disadvantage that when they are burned, the amount of free carbon formed by incomplete combustion is undesirably high, resulting in the formation of large amounts of soot and coke.

In order to overcome such undesirable properties of the bituminous substance, it is considered desirable to disperse water in the bituminous substance to accelerate the formation of fine bituminous substance particles, increase the combustion efficiency, and decrease the formation of soot and nitrogen oxides. This method, however, has several disadvantages. For example, the amount of water required for reducing the formation of soot and nitrogen oxides in accordance with such a method reaches from 5 to 20% by weight, based on the weight of the bituminous substances, and therefore the loss of heat into the steam being discharged is undesirably high. Furthermore, since the particle size of the dispersion composition is large and the dispersion is unstable, it is necessary to add emulsifiers.

U.S. Pat. No. 1,609,308 discloses a process for preparing an oil-in-water type dispersion composition in which asphalt and water are kneaded to allow the water to be absorbed in the asphalt, a dispersant such as colloidal clay is added thereto, and then water is gradually added thereto to cause the phase inversion (also referred to as phase reversal).

U.S. Pat. No. 2,247,722 and British Pat. No. 465,589 disclose a process for preparing an oil-in-water type dispersion composition in which tar, water and a water-soluble emulsifying agent are mixed to provide a water-in-oil type dispersion composition which is in turn added to and dispersed in an aqueous emulsifying agent solution to obtain the oil-in-water type dispersion composition.

U.S. Pat. No. 2,372,924 and British Pat. No. 506,300 disclose a process for preparing an oil-in-water type dispersion composition in which tar, water and an alkali-starch solution are mixed to provide a water-in-oil type dispersion composition which is in turn added to and dispersed in an alkali-starch solution and a large amount of an ammonia water to obtain the oil-in-water type dispersion composition.

However, neither the description suggesting the use of such oil-in-water type dispersion compositions as fuels, nor the description suggesting the incorporation of alcohols can be found.

Dispersion compositions composed of asphalt or tar and water, and containing no alcohol have poor stability and combustion properties, as illustrated in Comparative Examples 3 and 4 described hereinafter.

Japanese Patent Application (OPI) No. 160054/80 (the term "OPI" as used herein refers to a "published unexamined Japanese patent application") discloses a dispersion composition which is composed of a tar-like substance, an alcohol, and a dispersant, such as a partial saponification product of polyvinyl acetate. It has now been found, however, that although a part of the methanol is dissolved in the bituminous substance and the remainder is dispersed therein, the particle size of the dispersion composition is not uniform and the stability of the dispersion is poor. This indicates that such dispersion compositions composed of a tar-like substance and an alcohol, and containing no water have insufficient stability and are poor in the effect of reducing soot and nitrogen oxides as illustrated in Comparative Examples 1 and 2 as described hereinafter.

In addition, Japanese Patent Publication No. 4357/80 discloses a process for producing an emulsified fuel composed of a liquid hydrocarbon fuel, such as fuel oil and light oil, an alcohol, and water by the use of supersonic waves or a static mixer. There is, however, no disclosure concerning an emulsified fuel prepared using a bituminous substance, and also no disclosure concerning the preparation of dispersion compositions by kneading. In the use of a bituminous substance as a starting material, it is difficult to obtain the stable emulsified fuel by the supersonic waves or a static mixer.

These dispersions comprising bituminous substances and water or alcohols, therefore, are not suitable for practical use as fuels unless the stability of the dispersion and the economical efficiency are increased.

Japanese Patent Publication Nos. 31911/69 and 37675/78, and Japanese Patent Application Nos. 140974/79, 168961/79, 168962/79, 63001/80, 69343/80, and 131300/80 describe processes for producing dispersion compositions in which water-containing organic compounds such as peat and sludge, or aqueous organic compound-suspensions such as oil-containing waste water and emulsion waste water are kneaded with high viscoelastic substances such as atactic polypropylene and asphalt, to dehydrate the water-containing organic compound or aqueous organic compound-suspension and to allow the organic substance to be absorbed in the high viscoelastic substance. As one of the utilizations of the bituminous substance having an organic impurity absorbed thereto, the use as a fuel is considered. There is, however, no description concerning the incorporation of alcohols. Dispersion compositions containing no alcohol have poor stability and combustion properties.

SUMMARY OF THE INVENTION

An object of the invention is to provide a process for producing dispersion compositions usable as fuels from bituminous substances.

Another object of the invention is to provide a process for producing dispersion compositions comprising bituminous substances, water and alcohols, and having high stability and good combustion properties.

Still another object of the invention is to provide a process for producing stable water-in-oil type (hereinafter referred to as "w/o type") dispersion compositions from bituminous substances without the use of emulsifiers, or producing oil-in-water type (hereinafter referred to as "o/w type") dispersion compositions from bituminous substances by using protective colloids without the use of emulsifiers.

A further object of the invention is to provide a process for producing dispersion compositions suitable for use as fuels from bituminous substances, and, at the same time, for treating water-containing organic compounds or aqueous organic compound-suspensions to recover the organic compound for use thereof as fuel.

The present invention, therefore, provides a process for producing dispersion compositions suitable for use as fuels comprising kneading (a) a bituminous substance, (b) a low molecular weight aliphatic alcohol, and (c) water, a water-containing organic compound, or an aqueous organic compound-suspension, to provide a dispersion composition wherein an aqueous alcohol solution as a dispersed phase is dispersed in the bituminous substance as a continuous phase.

DETAILED DESCRIPTION OF THE INVENTION

As a result of extensive studies on dispersion compositions comprising bituminous substances and low molecular weight aliphatic alcohols to use the bituminous substances as fuels, it has now been found that when the low molecular weight aliphatic alcohols are used not singly, but in combination with water, the aqueous alcohol solution can be uniformly dispersed, and the dispersion compositions obtained have high stability and excellent combustion properties.

Although it is not completely clear why the dispersion composition is stabilized by addition of water, it is believed that the addition of water inhibits the solubilization of the alcohols in the bituminous substances, and, since water is an electrolyte, it propably forms an electrical double layer along with polar ingredients contained in the bituminous substance, thereby contributing to the stability of the dispersion of the aqueous alcohol solution.

In the case of bituminous substances, "dispersion" is generally used as a synonym for "emulsion", and therefore the term "dispersion" as used herein generically includes both dispersions and emulsions. Furthermore, a dispersion composition wherein the bituminous substance is present as a continuous phase is referred to as a "water-in-oil (w/o) type dispersion", and a dispersion composition wherein the aqueous alcohol solution is present as a continuous phase is referred to as an "oil-in-water (o/w) type dispersion".

The bituminous substance as used herein is a semi-solid or heavy liquid substance having a viscosity of at least about 20 centistokes (cst) at 50° C., preferably at least about 150 cst at 50° C. Examples of such bituminous substances include asphalt, crude oil, distillation residues of oil, tars or pitches obtained from coal, tar-sand and shale oil, and mixtures thereof. In addition, mixtures of bituminous substances and oils such as lubricant oil, right oil, gas oil and the like lighter than the bituminous substances can be used as long as they have a viscosity of at least about 20 centistokes at 50° C.

Examples of low molecular weight aliphatic alcohols include methanol, ethanol, propanol-2, n-propanol, and mixtures comprising two or more thereof. These alcohols containing 1 to 3 carbon atoms are suitable for use in the invention since they are completely miscible with water. In addition, a saponification waste liquid produced as a by-product in the production of polyvinyl alcohol can be used in place of such pure alcohols since it contains suspension solids of polyvinyl alcohol and partial saponification products of polyvinyl acetate in methanol or ethanol.

By kneading the bituminous substance with the low molecular weight aliphatic alcohol and water in accordance with the process of the invention, a w/o type dispersion composition wherein the aqueous alcohol solution is dispersed in the bituminous substance is obtained. Also, when a water-containing organic compound or aqueous organic compound-suspension is used in place of water, the same w/o type dispersion composition can be obtained.

Water-containing organic compounds and aqueous organic compound-suspensions which can be used in the practice of the invention include mixtures of fine solid organic compound particles or liquid organic compound particles and water in which the water content is relatively low (about 1 to less than 50% by weight), in the case of the water-containing organic compound, and in which the water content is relatively high (about 50% by weight or more), in the case of the aqueous organic compound-suspension.

Examples of such water-containing organic compounds include active sludge, sewerage, sludge, home waste sludge, peat, water-containing brown coal particles, water-containing coal powder, waste liquids containing suspension solids (e.g., mainly containing palm oil and tallow) formed during cold rolling of iron, muddy substances in extracts produced as by-products in the production of gelatin, muddy substances in molasses, and oil tank sludge.

Examples of aqueous organic compound-suspensions include suspension solutions prepared by diluting the above-described water-containing organic compounds with water, waste water containing suspension solids by-produced in the production of palm oil, sweet water (diluted aqueous solution of glycerol) containing suspended fatty materials, waste water containing suspension solids by-produced in the production of paper, waste water containing suspension solids formed in the production of ethylene-vinyl acetate emulsion copolymers and vinyl acetate emulsion polymers, waste water containing suspension solids formed in the suspension polymerization of styrene, process water containing suspension solids obtained in the production of epoxy resins, dyeing waste water containing suspension solids obtained during the step of dyeing, waste water containing oily substances from oil refining operations, cane juice containing colored substances in cane sugar processing, sulfuric acid washing waste liquid containing fine carbon particles and sludge resulting from sulfuric acid washing of gases in the oil refining operations, o/w type emulsions of cutting oil or rolling oil, and o/w type emulsions of oils or bituminous substances.

When these water-containing organic compounds or aqueous organic compound-suspensions contain large size impurities, such as long fibrous substances, stone and sand, the impurities are preliminarily removed by methods such as precipitation, decantation, and filtration.

The kneading of (a) the bituminous substance, (b) the low molecular weight aliphatic alcohol, and (c) water, the water-containing organic compound, or aqueous organic compound-suspension, may be carried out in various manners. For example, the components (a) and (b) can first be mixed and kneaded, and component (c) added thereto and kneaded; the components (a) and (c) can first be kneaded, and the component (b) added thereto and kneaded; or the components (a), (b) and (c) can be kneaded simultaneously.

Kneading can be performed by the use of a conventional kneader, a Banbury mixer, a screw press, an extruder or the like. These apparatuses have a kneading effect, i.e., the effects capable of pulling, stretching and stringing the material to be treated by a strong shearing force. Of these apparatuses, a kneader is particularly preferred. The kneader should be operated at a low speed, and the rotary speed of stirring blade of the kneader is usually from about 5 to 240 rpm, and preferably from about 10 to 120 rpm. If the kneader is operated at a high speed (>240), uniform kneading cannot be conveniently performed.

The kneading temperature must necessarily be higher than the solidification point of water, but lower than the boiling point of the alcohol or aqueous alcohol solution used, and it is preferably within the range of from about 0° C. to 65° C. It is most effective to perform the kneading of the bituminous substance, alcohol and/or water at such temperatures that the bituminous substance behaves like a viscoelastic material showing stringiness. These temperatures are usually within the range of from about 0° C. to 60° C. although they vary slightly depending on the type of the bituminous substance. The optimum kneading temperature is within the range of from about 15° C. to 60° C., and preferably about 20° C. to 60° C., in the case of semi-solid bituminous substances such as asphalt, and within the range of about 0° C. to 50° C., particularly about 10° to 40° C., in the case of liquid bituminous substances such as tar.

During the kneading, the water and alcohol are absorbed into the bituminous substance, and aqueous alcohol solution particles are dispersed in the bituminous substance to provide a w/o type dispersion composition. When a water-containing organic compound or aqueous organic compound-suspension is used instead of water, the organic compound is taken into the bituminous substance while the major portion of the water contained therein is removed therefrom. Thus, the organic compound and a mixture of the residual water and alcohol are independently dispersed in the bituminous substance finely and uniformly. Although the mechanism by which the organic compound in the water-containing organic compound or aqueous organic compound-suspension is concentrated and stored in the bituminous substance is not completely clear, it is believed that the water-containing organic compound or aqueous organic compound-suspension is first absorbed into the bituminous substance during the kneading and subsequently the aqueous alcohol solution having poor affinity for the bituminous substance separates from the bituminous substance system. Generally, the higher a kneading temperature, the larger an amount of aqueous alcohol solution absorbed into the bituminous substance.

The dispersion composition of the invention in which the foregoing aqueous alcohol solution particles are dispersed in the bituminous substance has good combustion properties and high stability when the water content of the dispersion composition is within the range of about 5 to 70 parts by weight per 100 parts by weight of the bituminous substance. When the water content is more than about 70 parts by weight per 100 parts by weight of the bituminous substance, the combustion properties and stability of the resulting dispersion composition are poor. Also, when the water content is less than about 5 parts by weight, the combustion properties deteriorate.

Therefore, in kneading (a) the bituminous substance, (b) the low molecular weight aliphatic alcohol, and (c) water, water-containing organic compound or aqueous organic compound-suspension, the kneading is continued until the amount of water absorbed in the bituminous substance reaches about 5 to 70 parts by weight per 100 parts by weight of the bituminous substance. Usually, the kneading time is sufficient within the range of from about 1 to 60 minutes. The water content in the dispersion composition obtained can be measured by distilling a sample thereof and determining the water formed.

In charging the components (a), (b), and (c) into a kneader, the amounts are controlled so that the total amount of the water and alcohol are usually from about 10 to 350 parts by weight, and preferably from about 20 to 140 parts by weight, per 100 parts by weight of the bituminous substance. It is wasteful to further increase the amount of the water and alcohol with respect to the bituminous substance. On the other hand, when the amount of the water and alcohol with respect to the bituminous substance is too small, a dispersion composition having good combustion properties cannot be obtained.

The dispersion composition of the invention has good combustion properties and high stability when the weight ratio of the alcohol to water is from about 1/0.1 to 1/10 and preferably from 1/0.2 to 1/3. The optimum weight ratio is 1/1. When the weight ratio of the alcohol to water is not within the foregoing range, the combustion properties and stability of the resulting dispersion composition deteriorate. Therefore, in charging the components (a), (b), and (c) into a kneader, it is preferred that the weight ratio of the alcohol to the water or water contained in the water-containing organic compound or aqueous organic compound suspension be controlled within the range of about 1/0.1 to 1/10. Furthermore, it is preferred to minimize the amount of the alcohol used in the dispersion composition within the foregoing range since the alcohol is expensive compared with the bituminous substance.

As the kneading is continued, the other components are mixed with and absorbed into the bituminous substance. As a result, the viscosity of the bituminous substance is changed, and in some cases, it becomes difficult to perform the kneading effectively. In this case, the viscosity of the bituminous substance can be controlled by changing the temperature or by adding additives. That is, when the viscosity of the bituminous substance is increased excessively, the kneading temperature is raised, or, alternatively, light oil, for example, is added as a viscosity-lowering agent. On the other hand, when the viscosity of the bituminous substance is decreased excessively, the kneading temperature is lowered, or alternatively thickening agents such as coal powder, polyvinyl alcohol powder, and atactic polypropylene are added.

The dispersion composition of the invention, if necessary, may contain sulfur trapping agents and protective colloids in the course of preparing the w/o type dispersion composition. These additives can be added before, after or during the kneading of the bituminous substance with the alcohol and water, and are kneaded with the bituminous substance.

Examples of sulfur trapping agents include $Ca(OH)_2$, $CaCO_3$, $(HCOO)_2Ca$, $Ba(OH)_2$, $BaCO_3$, $(HCOO)_2Ba$, $CaCO_3.MgCO_3$, $Mg(OH)_2$, $MgCO_3$, $(HCOO)_2Mg$, and the like. These sulfur trapping agents combine with sulfur compounds contained in the bituminous substance, thereby inactivating the sulfur compounds and preventing the conversion of the sulfur compounds into sulfur dioxide ($SO_2$) during the combustion thereof. The preferred amount of the sulfur trapping agent added is suitably from about 1 to 1.5 equivalents per equivalent of sulfur contained in the bituminous substance. The sulfur trapping agent is pulverized into very fine particles and dispersed in the bituminous substance by the kneading, as a result of which it works effectively as a sulfur trapping agent.

Examples of protective colloids include polyvinyl alcohol, partial saponification products of polyvinyl acetate, partial saponification products of an ethylene-vinyl acetate copolymer, partial esters of polyvinyl alcohol with higher aliphatic acid, and vinyl acetate-vinyl alcohol-vinyl alcohol higher aliphatic acid ester copolymers, and mixtures comprising two or more thereof. Among the above-described protective colloids, the preferred examples of a higher aliphatic acid capable of forming the partial esters thereof include an aliphatic carboxylic acid having 10 to 20 carbon atoms such as lauric acid, palmitic acid, stearic acid, oleic acid, etc. The addition of such protective colloids permits the formation of finer aqueous alcohol solution particles and the uniform dispersion of such aqueous alcohol solution particles. The amount of the protective colloid added is usually sufficient within the range of about 0.05 to 0.5 part by weight per 100 parts by weight of the bituminous substance.

The thus-obtained dispersion composition is a w/o type dispersion in which aqueous alcohol solution particles are dispersed in a continuous phase of the bituminous substance. When the water-containing organic compound or aqueous organic compound suspension is used in place of water, the organic compound is dispersed in the bituminous substance separately from the aqueous alcohol solution particles. These dispersion compositions can be freely mixed with oil-soluble liquids without the deterioration of the stability since they are w/o type dispersions. For example, in order to decrease the viscosity of the dispersion composition, light hydrocarbon oils such as kerosene, light oil, gas oil and lubricant oil, or petroleum residual oils may be mixed with the dispersion coposition. Also in this case, when the resulting dispersion composition is used as fuel, it is desirable that the water content of the dispersion composition is about 5 to 70 parts by weight per 100 parts by weight of the bituminous substance.

In accordance with the process of the invention, the w/o type dispersion composition wherein aqueous alcohol solution particles are dispersed in the bituminous substance can be subjected to phase inversion (phase reversal) of the emulsion to produce an o/w type dispersion composition wherein bituminous substance particles are dispersed in the aqueous alcohol solution. That is, it is possible to produce the o/w type dispersion composition wherein the bituminous substance as a dispersed phase is dispersed in the aqueous alcohol solution as a continuous phase which is suitable for use as fuel by causing the phase inversion of the w/o type dispersion composition wherein the aqueous alcohol solution as a dispersed phase is dispersed in the bituminous substance as a continuous phase by a procedure in which (d) protective colloids are added in an amount of about 1.5 to 5 parts by weight per 100 parts by weight of the bituminous substance contained in the w/o type dispersion composition and kneaded at a temperature of from about 5° C. to 60° C., preferably from about 15° C. to 45° C.

In this phase inversion, the same or similar type kneader as used in the preparation of the w/o type dispersion composition can be used. The kneading is performed by operating the kneader at a rotary speed of stirring blade of from about 5 to 240 rpm.

In kneading the w/o type dispersion composition with the protective colloid, the total weight of the aqueous alcohol solution present in the system should be controlled below the maximum absorption amount above which no more aqueous alcohol solution can be absorbed in the bituminous substance. If the aqueous alcohol solution is present in the system in an amount exceeding the maximum absorption amount, an excessive amount of aqueous alcohol solution remaining on the surface of the w/o type dispersion composition is previously removed by techniques such as decantation and filtration. If the w/o type dispersion composition and protective colloid are kneaded in the state that the aqueous alcohol solution in the amount exceeding the maximum absorption amount is present together with the w/o type dispersion composition, the phase inversion does not occur, or even though the phase inversion occurs, only an unstable dispersion composition wherein large particles are dispersed is obtained.

Examples of such protective colloids include polyvinyl alcohol, partial saponification products of polyvinyl acetate, partial saponification products of an ethylene-vinyl acetate copolymer, partial esters of polyvinyl alcohol with a higher aliphatic acid, vinyl acetate-vinyl alcohol-vinyl alcohol higher aliphatic acid ester copolymers, and mixtures comprising two or more thereof. Preferably, they are mixed with water and the mixture formed is added. When the amount of the protective colloid added is too small, the phase inversion does not occur. On the other hand, if the amount of the protective colloid added is too large, large masses are formed in the o/w type dispersion composition, causing the blockage of a burner nozzle in burning the o/w type dispersion composition. The process of the invention does not require an emulsifying agent. The kneading temperature is significant for the phase inversion, i.e., if the kneading temperature is too high or too low, the phase inversion does not occur satisfactorily and no stable o/w type dispersion composition will be obtained. Since the phase inversion is completed in relatively short periods of time, this kneading time is usually from about 1 to 20 minutes.

With the o/w type dispersion composition produced by the phase inversion, wherein bituminous substance particles are dispersed in the aqueous alcohol solution, the dispersion particles are very fine and the stability is very high. When the water-containing organic compound or aqueous organic compound suspension is used in place of water at the step of producing the w/o type dispersion composition, the organic compound is combined with the bituminous substance and is present in bituminous substance dispersion particles in the o/w type dispersion composition.

The thus-obtained o/w type dispersion composition is miscible in any proportions with water, low molecular weight aliphatic alcohols, such as methanol, ethanol and propanol, and water-soluble liquids, such as an aqueous alcohol solution, without the deterioration of the stability of the dispersion composition. It is preferred that the amount of the alcohol added is minimized, since alcohol is expensive compared with the bituminous substance. When the o/w type dispersion composition is used as a fuel, it is preferred that the water content of the dispersion composition is from about 5 to 70 parts by weight per 100 parts by weight of the bituminous substance.

The process of the invention permits the utilization as a good fuel of bituminous substances which have heretofore had only limited values. It is surprising that the quantity of energy consumed in the production of the dispersion composition of the invention is very small. In accordance with the process of the invention, the bituminous substance can be easily converted into the w/o type dispersion composition, and furthermore, the w/o type dispersion composition can be converted into the o/w type dispersion composition by a simplified procedure. Moreover, the w/o type and o/w type dispersion compositions have high stability without the addition of an emulsifying agent.

These dispersion compositions have good combustion properties, i.e., they produce only limited amounts of soot and nitrogen oxides, and when they initially begin to burn, they burn spontaneously (i.e., burn without self-extinguishing).

The advantage obtained by the use of the alcohol is that various problems arising in the use of water can be reduced even though the amount of the alcohol added is increased since the alcohol per se is combustible and has a low evaporation latent heat compared with water.

The advantages obtained by reducing the solubility of the alcohol and dispersing the alcohol in the bituminous substance by the use of water in combination with the alcohol are an increase in the combustion efficiency and a reduction in the amount of soot formed, which are based on the micro explosion theory. The micro explosion theory teaches that when an emulsified fuel is sprayed and burned, the moisture contained in the sprayed droplets as a dispersed phase or a continuous phase is rapidly boiled and the oil droplets are miro-exploded, and as a result, such droplets become smaller. Therefore, the burning time becomes shorter and the amount of nitrogen oxide formed is reduced. That is, it is believed that the formation of the nitrogen oxide is inhibited since the flame temperature is reduced by absorbing the evaporation latent heat and the sensible heat from the environments with the water evaporation.

When the dispersion composition of the invention is used as a fuel, it can be used as a usual fuel for a burner. In addition, it can be used as a fuel for use in a blast furnace. In this case, since the excessive air/fuel ratio can be reduced and a reducing atmosphere can be maintained, the waste gas can be withdrawn as a reformed gas (composed mainly of $H_2$ and CO). This leads to the advantage that the waste gas can be reused.

Furthermore, the process of the invention has the advantage that it can be utilized in disposing of water-containing organic compounds and aqueous organic compound suspensions, such as various sludges and waste water from factories.

The invention is described in detail by reference to the following examples, although it is not limited thereto.

EXAMPLE 1

A hundred parts by weight of straight asphalt (degree of penetration: 70; softening point: 48° C.; wherein the degree of penetration and softening point were determined according to JIS K2530 and JIS K2531, respectively) was kneaded at 25° C. in a small-sized stainless steel kneader (volume: 5 liters; a box-type kneader having a biaxial Z-type blade), and 5 parts by weight of water was added thereto and kneaded at 25° C. for 10 minutes at a rotary speed of stirring blade of the kneader of 90 rpm. The resulting mixture was further kneaded while gradually adding 10 parts by weight of methanol. When heat was released during kneading, cooling was applied so as to prevent the dissipation of the methanol. With the thus-obtained aqueous methanol solution-in-oil type fuel composition, the average size of aqueous methanol solution particles was from 2 to 5 microns, and it was stable even though it was allowed to stand at room temperature for 7 days. Further, it was stable even though it was allowed to stand for 3 months under the same condition.

The thus-formed fuel composition was preheated to 250° C. and burned in a boiler by the use of a steam-injection type burner. The length of flame was about 70 cm and spontaneously burned. The amounts of soot and nitrogen oxides in flue gas were 0.02 g/m$^3$ and 70 ppm (by weight) (oxygen: 0%), respectively.

The pressure at which the fuel composition was fed to the burner, and the amount in which the fuel composition was fed to the burner were 3.5 kg/cm$^2$ and 20 l/hr, respectively. The temperature in the furnace after burning for 30 minutes was 800° C., and the temperature of flue gas was 650° C.

EXAMPLE 2

A hundred parts by weight of straight asphalt (degree of penetration: 180; softening point: 40° C.), 16 parts by weight of industrial methanol, and 22 parts by weight of water were kneaded at a temperature of 40° C. by the use of the same kneader as in Example 1 until all the methanol and water were absorbed in the asphalt at a rotary speed of the stirring blade of the kneader of 90 rpm. Subsequently, 1.5 parts by weight of a partial saponification product of polyvinyl acetate (degree of saponification: 98.8%; degree of polymerization: 1,700) was added thereto at a temperature of 36° C. On kneading the resulting mixture for additional 1 minute, the color of the composition changed from black brown to brown, and the phase inversion proceeded completely. Then, 14 parts by weight of water was added thereto and kneaded to adjust the viscosity.

The thus-obtained dispersion composition was an o/w type dispersion in which the asphalt was dispersed in the aqueous alcohol solution, and the average size of dispersion particles was 0.1 to 2 microns. Even when the dispersion composition was allowed to stand for 3 months, no layer separation occurred, and the dispersion composition remained unchanged. Thus, the storage stability of the dispersion composition was good.

The dispersion composition was preheated to 60° C. and burned in a boiler by the use of an air-premixing type low pressure spray type burner (air pressure: 1.5 kg/cm$^2$). The amounts of soot and nitrogen oxides in flue gas were 0.01 g/m$^3$ and 80 ppm (amount of oxygen: 0%), respectively. The feed pressure and feed amount of the dispersion coposition to the burner were 3.5 kg/cm$^2$ and 20 l/hr, respectively. After combustion for 40 minutes, the temperature in the furnace was 850° C., and the temperature of flue gas was 680° C.

COMPARATIVE EXAMPLE 1

Seventy parts by weight of straight asphalt (degree of penetration: 70; softening point: 48° C.) and 14 parts by weight of methanol were charged to the same kneader as in Example 1 and kneaded at a rotary speed of stirring blade of 90 rpm at 25° C. for 15 minutes to produce a dispersion composition in which the methanol was dispersed in the asphalt.

The thus-obtained dispersion composition was preheated to 250° C. and burned in the same combustion apparatus as used in Example 1. The amounts of soot and nitrogen oxides in flue gas were 0.06 g/m$^3$ and 280 ppm (oxygen: 0%), respectively. After 7 days, a large amount of alcohol was separated from the dispersion composition.

COMPARATIVE EXAMPLE 2

To the dispersion composition in which methanol was dispersed in asphalt as produced in Comparative Example 1 was added 2.1 parts by weight of a partial saponification product of polyvinyl acetate (degree of saponification: 98.8%; degree of polymerization: 1,700). The resulting mixture was kneaded in the same kneader as in Example 1 at a rotary speed of stirring blade of 90 rpm at 25° C. to provide a dispersion composition in which the asphalt was dispersed in the methanol. In addition, 14 parts by weight of methanol was added thereto to produce a dispersion composition.

The thus-produced dispersion composition was burned in the same combustion apparatus and under the same combustion conditions as in Example 2. The amounts of soot and nitrogen oxides in flue gas were 0.05 g/m$^3$ and 180 ppm (oxygen: 0%), respectively. When the dispersion composition was allowed to stand for 14 days, a liquid phase and a solid phase were somewhat separated as an upper layer and a lower layer, respectively, and it was found that the storage stability of the dispersion composition was poor. At this time, dispersion particles in the dispersion compositions had sizes ranging between 10 microns and 20 microns, and they were in poor uniformity.

It can be seen that the dispersion compositions composed of asphalt and methanol, and not containing water, as produced in Comparative Examples 1 and 2, have poor stability and combustion properties compared with the dispersion compositions as produced in Examples 1 and 2.

COMPARATIVE EXAMPLE 3

A mixture of 100 parts by weight of straight asphalt (degree of penetration: 70; softening point: 48° C.) and 20 parts by weight of water was charged to the same kneader as in Example 1 and kneaded at a temperature of 30° C. at a rotary speed of stirring blade of the kneader of 90 rpm for 7 minutes to produce a w/o type dispersion composition in which water particles were dispersed in the asphalt.

Particle sizes of the dispersion composition were as large as 10 to 50 microns, and the dispersion particles had poor uniformity and stability. When the dispersion composition was burned in the same combustion apparatus and under the same combustion conditions as in Example 1, the state of flame was unstable and the state in which the dispersion composition was jetted from a burner nozzle was bad. The amounts of soot and nitrogen oxides in flue gas were 0.05 g/m$^3$ and 180 ppm (oxygen: 0%), respectively.

COMPARATIVE EXAMPLE 4

To the w/o type dispersion composition composed of asphalt and water as produced in Comparative Example 3 was added 3 parts by weight of a partial saponification product of polyvinyl acetate (degree of saponification: 98.8%; degree of polymerization: 1,700). On kneading the resulting mixture at a temperature of 30° C. at a rotary speed of stirring blade of 90 rpm by the use of the same kneader as in Example 1, the phase inversion was completed in 2 minutes, and an o/w type dispersion composition in which the asphalt was dispersed in water was obtained.

When the o/w type dispersion composition was allowed to stand for 7 days, an aqueous phase and a dispersed phase were somewhat separated as an upper layer and a lower layer, respectively, and the storage stability was poor. The o/w type dispersion composition was burned in the same combustion apparatus and under the same combustion conditions as in Example 2. Although the state of flame and the state in which the dispersion composition was jetted from a burner nozzle were somewhat stabilized compared with those in Comparative Example 3, they were not stabilized to an extent that was sufficiently satisfactory. The amount of soot and nitrogen oxides in flue gas were equal to those in Comparative Example 3.

It can be seen that the dispersion compositions composed of asphalt and water, and not containing alcohol as produced in Comparative Examples 3 and 4 have poor stability and combustion properties compared with the dispersion compositions as produced in Examples 1 and 2.

COMPARATIVE EXAMPLE 5

Straight asphalt (degree of penetration: 200; softening point: 38° C.) was preheated to 250° C. and burned in a furnace. The amounts of soot and nitrogen oxides in flue gas were 500 mg/m$^3$ and 300 ppm (oxygen: 4%), respectively.

It can be seen that asphalt per se has very poor combustion properties.

EXAMPLE 3

A mixture of 70 parts by weight of straight asphalt (degree of penetration: 100; softening point: 44° C.), 5 parts by weight of methanol, and 45 parts by weight of a cold rolling oil waste liquid from an iron manufacturing factory (composed mainly of palm sludge; water content: 20% by weight) was placed in a kneader (horizontal kneader having a biaxial paddle type blade; volume: 30 liters) and kneaded therein at a temperature of 30° C. at a rotary speed of stirring blade of 100 rpm for 10 minutes to produce a w/o type dispersion composition in which an aqueous methanol solution and palm sludge were dispersed in the asphalt.

When the thus-obtained dispersion composition was burned in the same combustion apparatus and under the same combustion conditions as in Example 1, it burned well spontaneously. The amounts of soot and nitrogen oxides in flue gas were 0.03 g/m$^3$ and 80 ppm (oxygen: 0%), respectively. The length of flame was about 70 cm. After combustion for 45 minutes, the temperature in the furnace was 850° C., and the temperature of the flue gas 680° C. The w/o type dispersion composition obtained was stable as same as in Example 1.

EXAMPLE 4

To the w/o type dispersion composition as produced in Example 3 was added a mixture of 1.4 parts by weight of a partial saponification product of polyvinyl acetate (degree of saponification: 98.8%; degree of polymerization: 1,700) and 1.4 parts by weight of polyvinyl alcohol (degree of polymerization: 1,500) as protective colloid. When the resulting mixture was kneaded at a temperature of 30° C. for 5 minutes by the use of the same kneader as used in Example 3, the phase inversion was completed, and an o/w type dispersion composition was obtained. In addition, 15 parts by weight of a mixed solution consisting of equal amounts of methanol and water was mixed therewith. With the thus-produced o/w type dispersion composition, the average grain size of dispersion asphalt particles was 1 to 2 microns, and the viscosity was 170 cst at 100° C.

The dispersion composition was burned in the same combustion apparatus and under the same combustion conditions as in Example 2. The length of flame was about 70 cm, and the dispersion composition burned well spontaneously. The amounts of soot and nitrogen oxides in flue gas were nearly equal to those in Example 3. Even though the dispersion composition was allowed to stand for 3 months, it was stable.

COMPARATIVE EXAMPLE 6

The procedure of Example 4 was repeated with the exception that the amounts of the partial saponification product of polyvinyl acetate and polyvinyl alcohol added were changed; i.e., a mixture of 0.4 part by weight of the partial saponification product of polyvinyl acetate and 0.4 part by weight of the polyvinyl alcohol was added as the protective colloid.

The phase inversion of the w/o type dispersion composition into an o/w type dispersion composition did not proceed at all, although the protective colloid was absorbed in the w/o type dispersion composition. This indicates that if the amount of the protective colloid being compounded is too small, the phase inversion does not proceed.

COMPARATIVE EXAMPLE 7

The procedure of Example 3 was repeated with the exception that the temperature at which 70 parts by weight of the straight asphalt, 5 parts by weight of methanol, and 45 parts by weight of the cold rolling oil waste liquid from an iron manufacturing factory were kneaded was changed to 3° C. After all the aqueous methanol solution which had not been absorbed into the asphalt was removed out of the resulting w/o type dispersion composition, the procedure of Example 4 was repeated with the exception that the temperature at which the w/o type dispersion composition and the protective colloid were kneaded was changed to 3° C. The phase inversion of the w/o type dispersion composition into an o/w type dispersion composition did not proceed at all. This indicates that if the kneading temperature is too low, the phase inversion does not proceed.

COMPARATIVE EXAMPLE 8

The procedure of Example 4 was repeated with the exception that the temperature at which the w/o type dispersion composition and the protective colloid were kneaded was changed to 68° C. The w/o type dispersion composition was converted into the state that it was half-melted, and even after it was kneaded for 20 minutes, the phase inversion of the w/o type dispersion composition into the o/w type dispersion composition did not occur. This indicates that if the kneading temperature is too high, the phase inversion does not proceed.

EXAMPLE 5

A mixture of 100 parts by weight of straight asphalt (degree of penetration: 60; softening point: 52° C.), 7 parts by weight of methanol, and 70 parts by weight of dyeing waste water with a waste dye suspended therein (organic carbon content: 245 ppm (by weight)) was placed in the same kneader as in Example 1 and kneaded at a temperature of 40° C. at a rotary speed of stirring blade of 50 rpm for 20 minutes. Thereafter, 27 parts by weight of an aqueous methanol solution which had not been absorbed was removed from the system. The organic carbon content resulting from the dyeing waste water of the aqueous methanol solution thus removed was 25 ppm.

To the w/o type dispersion composition in which the aqueous methanol solution particles and waste dye were dispersed in the asphalt was added 2.8 parts by weight of a partial saponification product of an ethylene-vinyl acetate copolymer (mol ratio of ethylene to vinyl acetate: 1/1; degree of saponification: 96%; degree of polymerization: 1,200) as a protective colloid. When the resulting mixture was kneaded at a temperature of 40° C. at a rotary speed of stirring blade of 50 rpm, the phase inversion was completed in 1 minute, and an o/w type dispersion composition was obtained. To the thus-obtained o/w type dispersion composition was added 12 parts by weight of water to produce an o/w type dispersion composition having a viscosity of 150 cst at 100° C.

The o/w type dispersion composition thus-produced was burned in the same combustion apparatus and under the same conditions as in Example 2. The length of flame was about 60 cm, and the dispersion composition burned well spontaneously. The amounts of soot and nitrogen oxide in the flue gas were nearly equal to those in Example 2. Even after the dispersion composition was allowed to stand for 6 months, it was stable.

COMPARATIVE EXAMPLE 9

The procedure of Example 5 was repeated with the exception that in the course of producing the w/o type dispersion composition composed of the asphalt, methanol and dyeing waste water, the aqueous alcohol solution remained unabsorbed was not withdrawn out of the system. Although the phase inversion began to proceed, the o/w type dispersion composition formed immediately returned to the original w/o type dispersion composition, and no o/w type dispersion composition was obtained.

COMPARATIVE EXAMPLE 10

The procedure of Example 5 was repeated with the exceptions that in the course of producing the w/o type dispersion composition composed of the asphalt, methanol and dyeing waste water, the aqueous alcohol solution remained unabsorbed was not withdrawn out of the system, and that 5.6 parts by weight of a partial saponification product of polyvinyl acetate (degree of saponification: 98.8%; degree of polymerization: 1,700) was used in place of 2.8 parts by weight of the partial saponification product of the ethylene-vinyl acetate copolymer as the protective colloid. The phase inversion was completed in a short period of time, and an o/w type dispersion composition was obtained.

With the thus-obtained o/w type dispersion composition, sizes of asphalt particles were as large as 70 to 300 microns, and the dispersion was not uniform. After 10 hours, the dispersion composition was separated into two layers of a liquid phase and a solid phase, and it could not be used as a fuel.

Comparative Examples 9 and 10 indicate that if the protective colloid is kneaded with the w/o type dispersion composition without withdrawing the aqueous alcohol solution not absorbed in the asphalt in the course of producing the w/o type dispersion composition, the phase inversion does not proceed well.

EXAMPLE 6

The procedure of Example 5 was repeated with the exception that a mixture of 1.96 parts by weight of polyvinyl alcohol (degree of polymerization: 1,500) and 0.84 part by weight of dextrin was used in place of 2.8 parts by weight of the partial saponification product of the ethylene-vinyl acetate copolymer as the protective colloid to thereby cause the phase inversion of the w/o type dispersion composition and produce an o/w type dispersion composition.

The stability and combustion properties of the thus-obtained o/w type dispersion composition were equal to those in Example 5.

EXAMPLE 7

When 100 parts by weight of blown asphalt (an air-blown petroleum residual oil; degree of penetration: 20; softening point: 83° C.) and 30 parts by weight of ethanol were charged into the same kneader as in Example 1 and kneaded therein at a temperature of 50° C. at a rotary speed of stirring blade of 50 rpm for 10 minutes, the ethanol was absorbed completely in the asphalt. Subsequently, 150 parts by weight of active sludge (water content: 80% by weight) was added to the asphalt-ethanol dispersion as produced above and kneaded for 10 minutes. Then, 60 parts by weight of cleaned and separated water was withdrawn out of the system to provide a w/o type dispersion composition in which the aqueous ethanol solution and active sludge were dispersed in the asphalt. With the thus-produced w/o type dispersion composition, the average size of aqueous ethanol solution particles was 0.2 to 1 micron, and the viscosity was 1,200 cst at 100° C.

The dispersion composition thus-produced was mixed with 20 parts by weight of petroleum residual oil (viscosity: 150 cst at 50° C.), preheated to 150° C. and burned in the same combustion apparatus and under the same conditions as in Example 1. The length of flame was about 70 cm, and the mixture well burned spontaneously. The amounts of soot and nitrogen oxides in flue gas were nearly equal to those in Example 1.

EXAMPLE 8

A w/o type dispersion composition was produced in the same manner as in Example 7 except that 150 parts by weight of waste water formed in the production of pulp (water content: 80% by weight) was used in place of the active sludge.

The stability and combustion properties of the w/o type dispersion composition thus-produced were equal to those in Example 7.

EXAMPLE 9

When 100 parts by weight of straight asphalt (degree of penetration: 200; softening point: 38° C.), 10 parts by weight of humus (a water content: 4% by weight; obtained by dehydrating and removing long fibrous materials from peat collected in Hokkaido, Japan) and 5 parts by weight of water were charged into the same kneader as in Example 1 and kneaded at a temperature of 30° C. at a rotary speed of stirring blade of 50 rpm, all the humus was absorbed in the asphalt, and a w/o type dispersion composition in which the water and humus were dispersed in the asphalt was obtained.

To the thus-obtained w/o type dispersion composition was added 15 parts by weight of methanol. On continuing the kneading of the resulting mixture, a w/o type dispersion composition in which the aqueous alcohol solution and humus were dispersed in the asphalt was obtained. Then, 30 parts by weight of petroleum residual oil (viscosity: 150 cst at 50° C.) was added to the w/o type dispersion composition thus-produced to lower the viscosity of the dispersion composition to 60 cst at 100° C.

The w/o type dispersion composition was burned in the same combustion apparatus and under the same conditions as in Example 1. The length of flame was about 70 cm, and the dispersion composition burned well spontaneously. The amounts of soot and nitrogen oxide in flue gas were 0.02 g/m$^3$ and 70 ppm, respectively. The w/o type dispersion composition obtained was stable as same as in Example 1.

EXAMPLE 10

To the w/o type dispersion composition as produced in Example 9 was added coarsely pulverized $CaCO_3$ as a sulfur trapping agent in an amount of 1.2 equivalents per equivalent of the sulfur contained in the asphalt (sulfur content: 5% by weight) in the form of a paste that was prepared by mixing with 6 parts by weight of water. On kneading the mixture for 2 minutes, $CaCO_3$ was uniformly dispersed in the asphalt.

With the thus-produced dispersion, the average size of aqueous alcohol solution particles was 0.1 to 5 microns. To the dispersion was then added 0.2 part by weight of a partial saponification product of polyvinyl acetate (degree of saponification: 90%; degree of polymerization: 1,700) as a protective colloid. On kneading the resulting mixture, the average size of aqueous alcohol solution dispersion particles in the w/o type dispersion composition formed was changed to 0.01 to 1 micron. In addition, 30 parts by weight of petroleum residual oil (viscosity: 150 cst at 50° C.) was added to the resultant composition and kneaded.

The thus-produced dispersion composition was burned in the same combustion apparatus and under the same combustion conditions as in Example 1. The amounts of soot and nitrogen oxides in flue gas were equal to those in Example 9, and the amount of $SO_2$ was reduced to 20% that in Example 9.

EXAMPLE 11

A w/o type dispersion composition was produced in the same manner as in Example 10 except that $BaCO_3$ was used as a sulfur trapping agent in an amount of 1.3 equivalents per equivalent of the sulfur contained in the asphalt in place of the $CaCO_3$.

The combustion test results were equal to those in Example 10.

EXAMPLE 12

A w/o type dispersion composition was produced in the same manner as in Example 10 except that $(HCOO)_2Ca$ was used as a sulfur trapping agent in an amount of 1.2 equivalents per equivalent of the sulfur contained in the asphalt in place of the $CaCO_3$, and 20 parts by weight of kerosene was used in place of the petroleum residual oil.

The combustion test results were equal to those in Example 10.

EXAMPLE 13

A w/o type dispersion composition was produced in the same manner as in Example 10 except that $Ca(OH)_2$ was used in an amount of 1.2 equivalents per equivalent of the sulfur contained in the asphalt in place of the $CaCO_3$.

The combustion test results were nearly equal to those in Example 10.

EXAMPLE 14

A w/o type dispersion composition was produced in the same manner as in Example 10 except that $CaCO_3.MgCO_3$ was used in an amount of 1.2 equivalents per equivalent of the sulfur contained in the asphalt in place of the $CaCO_3$.

The combustion test results were equal to those in Example 10.

EXAMPLE 15

A w/o type dispersion composition was produced in the same manner as in Example 10 except that 0.3 part by weight of a partial esterification product of oleic acid and polyvinyl alcohol (degree of polymerization: 1,500) (degree of esterification: 20%) was used as a protective colloid in place of the partial saponification product of polyvinyl acetate.

The combustion test results were equal to those in Example 10.

EXAMPLE 16

A mixture of 50 parts by weight of straight asphalt (degree of penetration: 60; softening point: 52° C.), 50 parts by weight of petroleum residual oil (viscosity: 150 cst at 50° C.), 100 parts by weight of a waste liquid (water content: 97% by weight) formed in the production of gelatin, and 10 parts by weight of propanol-2 was placed in the same kneader as in Example 3 and kneaded therein at a temperature of 40° C. at a rotary speed of the stirring blade of 120 rpm for 5 minutes. At the end of the time, 57 parts by weight of the aqueous alcohol solution remained unabsorbed (the organic carbon content resulting from the gelatin waste liquid was reduced to 12% of the original value, and the propanol-2 was contained in a proportion of 9.3% by weight) was withdrawn out of the system to produce a w/o type dispersion composition composed of the asphalt, gelatin waste liquid and propanol-2.

To the thus-produced w/o type dispersion composition was added 5 parts by weight of a mixture consisting of equal amounts of polyvinyl alcohol (polymerization degree: 1,500) and starch in the form of a paste that was prepared by dissolving the mixture in water. When the resulting mixture was kneaded at a temperature of 40° C. for 2 minutes, the phase inversion of the w/o type dispersion composition was completed, and an o/w type dispersion composition was obtained. Then, 10 parts by weight of water was added to the o/w type dispersion composition to adjust the viscosity.

The thus-produced dispersion composition was preheated to 60° C. and burned in the same combustion apparatus and under the same combustion conditions as in Example 2. The combustion test results were equal to those in Example 2, and the stability of the dispersion composition was equal to that in Example 2.

EXAMPLE 17

A mixture of 100 parts by weight of straight asphalt (degree of penetration: 100; softening point: 44° C.), 50 parts by weight of sewerage sludge (water content: 85% by weight), and 7.5 parts by weight of ethanol was placed in the same kneader as in Example 1 and kneaded at a temperature of 60° C. at a rotary speed of stirring blade of 100 rpm for 10 minutes to produce a w/o type dispersion composition in which the aqueous ethanol solution and sludge were dispersed in the asphalt.

To the thus-produced w/o type dispersion composition was added 40 parts by weight of a mixture of petroleum residual oil (viscosity: 15 cst at 50° C.) and petroleum residual oil (viscosity: 150 cst at 50° C.) (mixing weight ratio: 3/7), and the resulting mixture was kneaded at a temperature of 30° C. for 5 minutes.

The dispersion composition thus produced was preheated to 93° C. and burned in the same combustion apparatus and under the same combustion conditions as in Example 1.

The combustion test results were equal to those in Example 1, and the stability of the dispersion composition was equal to that in Example 1.

EXAMPLE 18

A mixture of 100 parts by weight of straight asphalt (degree of penetration: 200; softening point: 38° C.) and 10 parts by weight of ethanol was charged into a kneader (horizontal kneader having a biaxial paddle type blade; volume: 200 liters) and kneaded therein at a temperature of 35° C. at a rotary speed of the stirring blade of 30 rpm to allow the ethanol to be completely absorbed in the asphalt.

To the thus-produced dispersion was added 100 parts by weight of oil-containing waste water (water content: 98% by weight) collected at the outlet of a parallel plate interceptor type oil-water separator in an oil refinery, and the resulting mixture was kneaded under the same conditions as described above for 10 minutes. Then, 88 parts by weight of the cleaned and separated water which had not been absorbed (the oil content was 1 ppm (by weight) as determined by an n-hexane extraction method) was withdrawn out of the system, and 20 parts by weight of petroleum residual oil (viscosity: 150 cst at 50° C.) was added to the system. The resulting mixture was kneaded for 5 minutes to produce a w/o type dispersion composition.

The w/o type dispersion composition thus-produced was preheated to 93° C. and burned in the same apparatus and under the same conditions as in Example 1.

The combustion test results were equal to those in Example 1, and the stability of the dispersion composition was equal to that in Example 1.

EXAMPLE 19

A w/o type dispersion composition was produced in the same manner as in Example 18, except that 100 parts by weight of tar (4,300 cst at 50° C.) obtained from tar sand was used in place of the straight asphalt.

The combustion test results were equal to those in Example 1, and the stability of the dispersion composition was equal to that in Example 1.

While the invention has been described in detail and with reference to specific embodiments thereof, it will be apparent to one skilled in the art that various changes and modifications can be made therein without departing from the spirit and scope thereof.

What is claimed is:

1. A process for producing a w/o type dispersion composition suitable for use as a fuel, comprising kneading (a) a bituminous substance which is a semi-solid or heavy liquid substance having a viscosity of at least 20 cSt at 50° C., (b) a low molecular weight aliphatic alcohol, and (c) water, a water-containing organic compound, or an aqueous organic compound suspension, said water-containing organic compound and said aqueous organic compound suspension being a mixture of fine solid organic compound particles or liquid organic compound particles and water, said kneading being performed at a temperature ranging between about 0° C. and 65° C., to provide a w/o type dispersion composition wherein the aqueous alcohol solution as a dispersed phase is dispersed in the bituminous substance as an continuous phase.

2. A process for producing a o/w type dispersion composition suitable for use as a fuel which comprises kneading (a) a bituminous substance which is a semi-solid or heavy liquid substance having a viscosity of at least 20 cSt at 50° C., (b) a low molecular weight aliphatic alcohol, and (c) water, a water-containing organic compound, or an aqueous organic compound suspension, said water-containing organic compound and said aqueous organic compound suspension being a mixture of fine solid organic compound particles or liquid organic compound particles and water, said kneading being performed at a temperature ranging between about 0° C. and 65° C., to provide a w/o type dispersion composition wherein the aqueous alcohol solution as a dispersed phase is dispersed in the bituminous substance as a continuous phase, adding to said w/o type dispersion composition (d) a protective colloid in an amount of 1.5 to 5 parts by weight per 100 parts by weight of the bituminous substance contained in said w/o type dispersion composition, said protective colloid being selected from the group consisting of polyvinyl alcohol, a partial saponification product of polyvinyl acetate, a partial saponification product of an ethylene-vinyl acetate copolymer, and mixtures comprising two or more thereof, and kneading the resulting mixture at a temperature ranging between about 5° C. and 60° C., to cause phase inversion of said dispersion composition and to provide a o/w type dispersion composition wherein the bituminous substance as a dispersed phase is dispersed in the aqueous alcohol solution as a continuous phase.

3. A process as in claim 1 or 2, wherein the components (a), (b), and (c) are kneaded at a temperature ranging between about 0° C. and 65° C.

4. A process as in claim 1 or 2, wherein the components (a), (b), and (c) are kneaded in a kneader at a rotary speed of the stirring blade of the kneader of from 5 to 240 rpm.

5. A process as in claim 1 or 2, wherein the components (a), (b), and (c) are kneaded until the amount of water absorbed in the bituminous substance reaches from 5 to 70 parts by weight per 100 parts by weight of the bituminous substance.

6. A process as in claim 1 or 2, wherein the weight ratio of the low molecular weight aliphatic alcohol to the water, or water contained in the water-containing organic compound or the aqueous organic compound suspension, is from 1/0.1 to 1/10.

7. A process as in claim 1 or 2, wherein the components (a), (b), and (c) are kneaded simultaneously.

8. A process as in claim 1 or 2, wherein the components (a) and (b) are first kneaded, and then the component (c) is added thereto and kneaded.

9. A process as in claim 1 or 2, wherein the components (a) and (c) are first kneaded, and then the component (b) is added thereto and kneaded.

10. A process as in claim 1 or 2, wherein the components (a), (b), and (c) are kneaded in the presence of a sulfur trapping agent.

11. A process as in claim 10, wherein the sulfur trapping agent is selected from the group consisting of $Ca(OH)_2$, $CaCO_3$, $(HCOO)_2Ca$, $Ba(OH)_2$, $BaCO_3$, $(HCOO)_2Ba$, $CaCO_3.MgCO_3$, $Mg(OH)_2$, $MgCO_3$ and $(HCOO)_2Mg$.

12. A process as in claim 1 or 2, wherein the components (a), (b) and (c) are kneaded in the presence of a protective colloid present in an amount of from 0.05 to 0.5 part by weight per 100 parts by weight of the bituminous substance in the course of preparing the water-in-oil type dispersion composition, said protective colloid being selected from the group consisting of a partial saponification product of polyvinyl acetate, a partial ester of polyvinyl alcohol with a higher aliphatic acid, and a vinyl acetate-vinyl alcohol-vinyl alcohol higher aliphatic acid ester copolymer.

13. A process as in claim 12, wherein the protective colloid is selected from the group consisting of polyvinyl alcohol, a partial saponification product of an ethylene-vinyl acetate copolymer, a partial saponification product of polyvinyl acetate, a partial ester of polyvinyl alcohol with a higher aliphatic acid, and a vinyl acetate-vinyl alcohol-vinyl alcohol higher aliphatic acid ester copolymer.

14. A process for producing a fuel composition which comprises mixing a w/o type dispersion composition, wherein an aqueous low molecular weight aliphatic alcohol solution is dispersed in a bituminous substance according to the process of claim 1, with an oil-soluble liquid to convert the dispersion composition into a w/o type dispersion composition whose water content is from 5 to 70 parts by weight per 100 parts by weight of the bituminous substance.

15. A process for producing a fuel composition which comprises mixing a o/w type dispersion composition, wherein a bituminous substance is dispersed in an aqueous low molecular weight aliphatic alcohol solution according to the process of claim 2, with water, a low molecular weight aliphatic alcohol, or a mixture thereof, to convert the dispersion composition into a o/w type dispersion composition whose water content is from 5 to 70 parts by weight per 100 parts by weight of the bituminous substance.

16. A process as in claim 1 or 2, wherein the bituminous substance is selected from the group consisting of asphalt, crude oil, a distillation residue of oil, tar, pitch, and mixtures comprising two or more thereof.

17. A process as in claim 1 or 2, wherein the low molecular weight aliphatic alcohol is selected from the group consisting of methanol, ethanol, propanol-2, and n-propanol, and mixtures comprising two or more thereof.

18. A process as in claim 1, wherein the protective colloid is selected from the group consisting of polyvinyl alcohol, a partial saponification product of polyvinyl acetate, a partial saponification product of an ethylene-vinyl acetate copolymer, a partial ester of polyvinyl alcohol with a higher aliphatic acid, a vinyl acetate-vinyl alcohol-vinyl alcohol higher aliphatic acid ester copolymer, and mixtures comprising two or more thereof.

19. A process as in claim 1 or 2, wherein the water-containing organic compound or aqueous organic compound suspension is selected from the group consisting of active sludge, sewerage sludge, home waste sludge, peat, water-containing brown coal particles, water-containing coal powder, waste liquids containing suspension solids formed during cold rolling of iron, muddy substances in extracts produced as a by-product in the production of gelatin, muddy substances in molasses, oil tank sludge, aqueous wastes containing suspension solids by-produced in the production of palm oil, sweet water containing suspended fatty materials, aqueous wastes containing suspension solids by-produced in the production of paper, aqueous wastes containing suspension solids by-produced in the production of an ethylene-vinyl acetate emulsion polymer or vinyl acetate emulsion polymer, aqueous wastes containing suspension solids formed in the suspension polymerization of styrene, process water containing suspended solids formed in the production of epoxy resins, dyeing waste water containing suspended solids obtained during the step of dyeing, aqueous wastes containing oily substances from oil refining operations, cane juice containing colored substances in cane sugar processing, sulfuric acid washing waste liquids containing fine carbon particles and sludge resulting from sulfuric acid washing of gases in oil refining operations, oil-in-water type waste emulsions of cutting oil and rolling oil, oil-in-water type emulsions of oils and bituminous substances, and mixtures comprising two or more thereof.

20. A process as in claim 1 or 2, wherein the components (a), (b), and (c) are kneaded in a kneader at a rotary speed of the stirring of the kneader blade of from 10 to 120 rpm.

21. A process as in claim 1 or 2, wherein the weight ratio of the low molecular weight aliphatic alcohol to the water, or water contained in the water-containing organic compound or the aqueous organic compound suspension, is from 1/0.2 to 1/3.

* * * * *